US006959749B2

(12) United States Patent
Hsu

(10) Patent No.: US 6,959,749 B2
(45) Date of Patent: Nov. 1, 2005

(54) PATTERN VARIABLE FABRIC DRAPERY

(75) Inventor: Pey-Son Hsu, Changhua Hsien (TW)

(73) Assignee: Ching Feng Blinds, Ind. Co., Ltd., Changhua Hsien (TW)

( * ) Notice: Subject to any disclaimer, the term of this patent is extended or adjusted under 35 U.S.C. 154(b) by 186 days.

(21) Appl. No.: 10/449,122

(22) Filed: Jun. 2, 2003

(65) Prior Publication Data

US 2004/0238129 A1 Dec. 2, 2004

(51) Int. Cl.[7] ..... E06B 3/48
(52) U.S. Cl. ..... 160/84.01; 160/84.07
(58) Field of Search ..... 160/84.07, 84.03, 160/84.04, 84.05, 330, 340, 348, 84.01

(56) References Cited

U.S. PATENT DOCUMENTS 5,197,526 A * 3/1993 Schon ..... 160/84.07
5,207,257 A * 5/1993 Rupel et al. ..... 160/84.07
5,341,864 A * 8/1994 Rupel et al. ..... 160/84.03
6,431,245 B1 * 8/2002 Shen ..... 160/84.03
6,591,887 B1 * 7/2003 Hsu ..... 160/84.03
6,679,309 B2 * 1/2004 Hsu ..... 160/84.01

* cited by examiner

*Primary Examiner*—David Purol
(74) *Attorney, Agent, or Firm*—Troxell Law Office, PLLC

(57) ABSTRACT

A pattern variable fabric drapery comprises an upper beam with a double-layered fabric drapery attached thereto wherein the upper section of the double-layered fabric drapery has a plurality of elongated tubular holes equidistantly disposed thereon for long rods to be adapted therein, and the lower section thereof has a plurality of symmetrical left and right tubular holes disposed thereon for left and right elongated rods to be adapted therein respectively The fabric drapery thereof also includes a plurality of left and right hanging pieces with hanging rings and central hanging pieces with cord-passage rings seamed into a Y-shaped pattern thereon for a left and a right pull cords to be adapted thereto; whereby, via the left and right pull cords without any preset extra length reserved, the fabric drapery thereof is gathered up with the lower section thereof raised up in a fan-like pattern and the upper section thereof withdrawn orderly in folds, economically simplifying the process of assembly and reducing the costs of materials as well as production thereof. Besides, the left and right hanging pieces thereof can also be seamed into two parallel lines thereon with the same effect thereof.

3 Claims, 6 Drawing Sheets

PATTERN VARIABLE FABRIC DRAPERY

BACKGROUND OF THE INVENTION

The present invention is related to a pattern variable fabric drapery, comprising an upper beam with a double-layered fabric drapery attached thereto wherein the upper section of the double-layered fabric drapery has a plurality of elongated tubular holes equidistantly disposed thereon for long rods to be adapted therein, and the lower section thereof has a plurality of symmetrical left and right tubular holes disposed thereon for left and right elongated rods to be adapted therein respectively. The fabric drapery thereof also includes a plurality of left and right hanging pieces with hanging rings and central hanging pieces with cord-passage rings seamed into a Y-shaped pattern thereon for a left and a right pull cords to be adapted thereto; whereby, via the left and right pull cords without any preset extra length reserved, the fabric drapery thereof is easily unfolded or quickly gathered up with the lower section thereof raised up in a fan-like pattern and the upper section thereof withdrawn orderly in folds, economically simplifying the process of assembly and reducing the costs of materials as well as production thereof. The left and right hanging pieces thereof can also be seamed into two parallel lines with the same effect thereof.

Refer to FIG. 1. A conventional folding blind structure comprises an upper beam 10 and a fabric drapery 20 attached thereto. The fabric drapery 20 extending downwards has a plurality of equal spaced folding lines 21 disposed from top to bottom thereon, each having a central hanging ring 211 seamed at the middle thereof. The upper section of the fabric drapery 20 has a plurality of left and right hanging rings 212 disposed in parallel at both sides of the folding lines 21 thereof. The middle section of the fabric drapery 20 is seamed with a tubular hole 22 for an elongated rod 221 to be adapted therein, and the lower section thereof has a bottom tubular hole 23 for a pair of left and right bottom rods 231 to be led therein and sealed up at both sides thereof. A main driving means 11 disposed at one side of the upper beam 10, and a first and a second sub-driving means 12, 13 disposed at the center and the other side of the upper beam 10 thereof respectively are provided for a pull cord unit 30 to be adapted thereto.

The pull cord unit 30 is made up of a right and a left pull cords 31, 32, a central pull cord 33, a main pull cord 34, and a locating piece 35. When the fabric drapery 20 is fully unfolded and extended downwards, the right pull cord 31 is attached at one end to the locating piece 35 suspending beneath the main driving means 11 and then reserved for a preset extra length before passed through the main driving means 11 and the first and the second sub-driving means 12, 13 respectively and led through the right hanging rings 212 to be attached to the tubular hole 22 at the other end thereof The central pull cord 33 is attached at one end to the locating piece 35 thereof before passed through the main driving means 11 and the first sub-driving means 12 respectively and led downwards through the central hanging rings 211 to be attached at the other end to a bottom ring 24 disposed at the bottom tubular hole 23 thereof The left pull cord 32 is attached at one end to the locating piece 35 and then reserved for a preset extra length before led through the main driving means 11 and extended downwards to pass through the left hanging rings 212 and attach to the tubular hole 22 at the other end thereof The main pull cord 34 is attached to the bottom of the locating piece 35 thereof and extended downwards for a proper length.

Refer to FIG. 2. To gather up the conventional fabric drapery 20 thereof, the locating piece 35 is pulled downwards via the main pull cord 35 to draw up first the lower section of the fabric drapery 20 via the central pull cord 33 with both left and right bottom rods 231 suspending downwards, figuring out a fan-like pattern at the bottom thereof. When the preset extra length thereof are fully stretched downwards, the right and left pull cords 31, 32 will raise up the elongated rod 221 levelly to fold up the upper section of the fabric drapery 20 orderly via the folding lines 211 thereof to complete the withdrawal of the fabric drapery 20 thereof.

There are some drawbacks to such conventional drapery fabric 20. First, the pull cord unit 30 made up of the right and left pull cords 31, 32 and the central pull cord 33 is adapted to the main driving means 11 and the first and second sub-driving means 12, 13, which is quite complicated in assembly. Second, central hanging rings 211, and left and right hanging rings 212 are disposed at the center and the upper lateral sides of the fabric drapery 20 thereof, which are tedious and time-consuming in production. Third, preset extra length of the right and left pull cords 31, 32 are reserved for complete withdrawal of fabric drapery 20 thereof, which uneconomically boost the cost of materials and production thereof.

SUMMARY OF THE PRESENT INVENTION

It is, therefore, the primary purpose of the present invention to provide a pattern variable fabric drapery, comprising an upper beam with a double-layered fabric drapery attached thereto wherein the upper section of the double-layered fabric drapery has a plurality of elongated tubular holes disposed thereon for long rods to be adapted therein, and the lower section thereof has a plurality of symmetrical left and right tubular holes disposed thereon for left and right elongated rods to be adapted therein respectively. The fabric drapery thereof also has a plurality of left and right hanging pieces with hanging rings, and central hanging pieces with cord-passage rings seamed into a Y-shaped pattern thereon, matching to a left and a right pull cords; whereby, via the left and right pull cords without any preset extra length reserved, the fabric drapery thereof is easily unfold or quickly withdrawn, economically simplifying the process of assembly and reducing the costs of materials as well as production thereof.

DETAILED DESCRIPTION OF THE PREFERRED EMBODIMENTS

Figure 1:
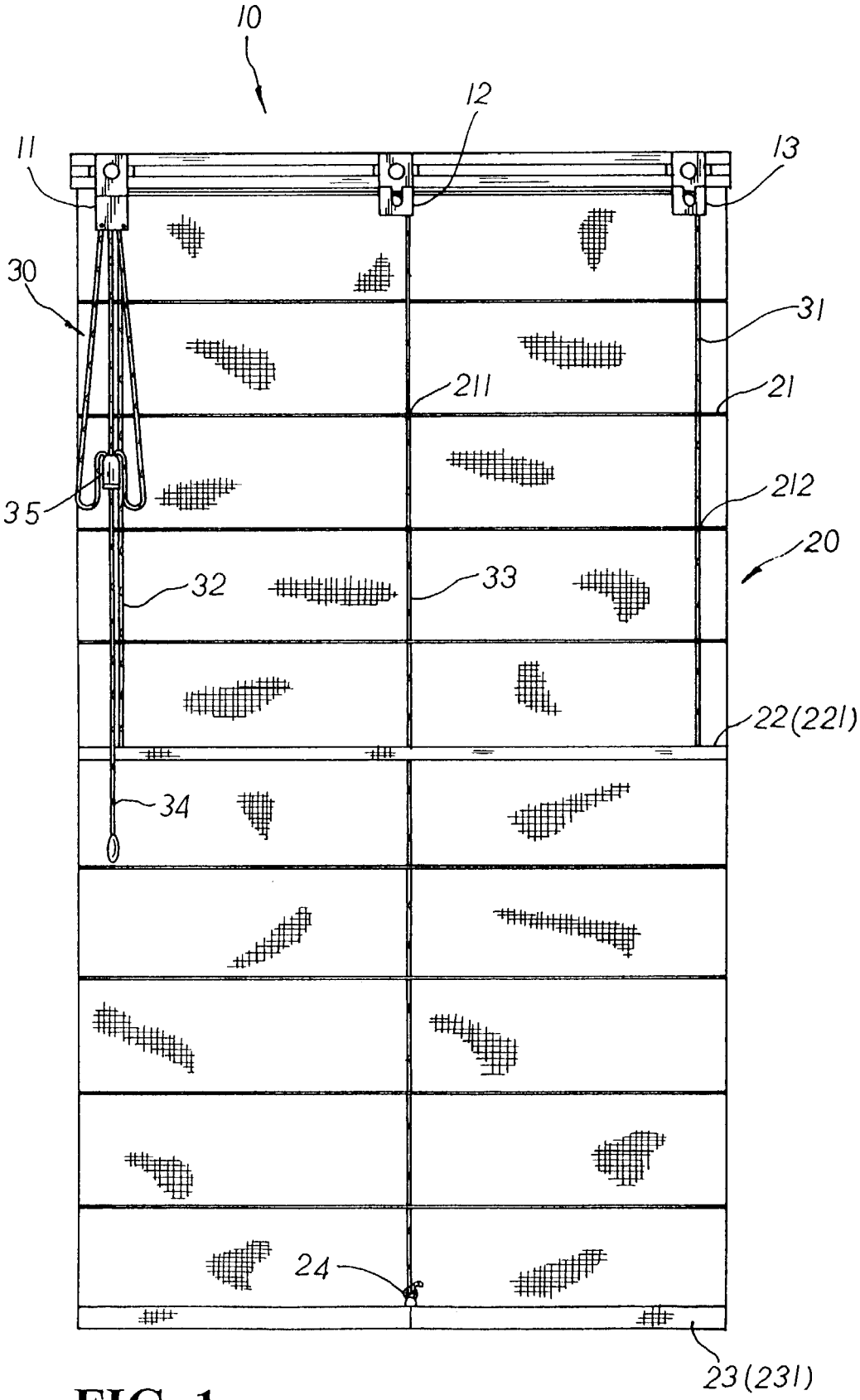
FIG. 1 PRIOR ART
FIG. 1 is a sectional view of a conventional fabric drapery fully unfolded.
Figure 2:
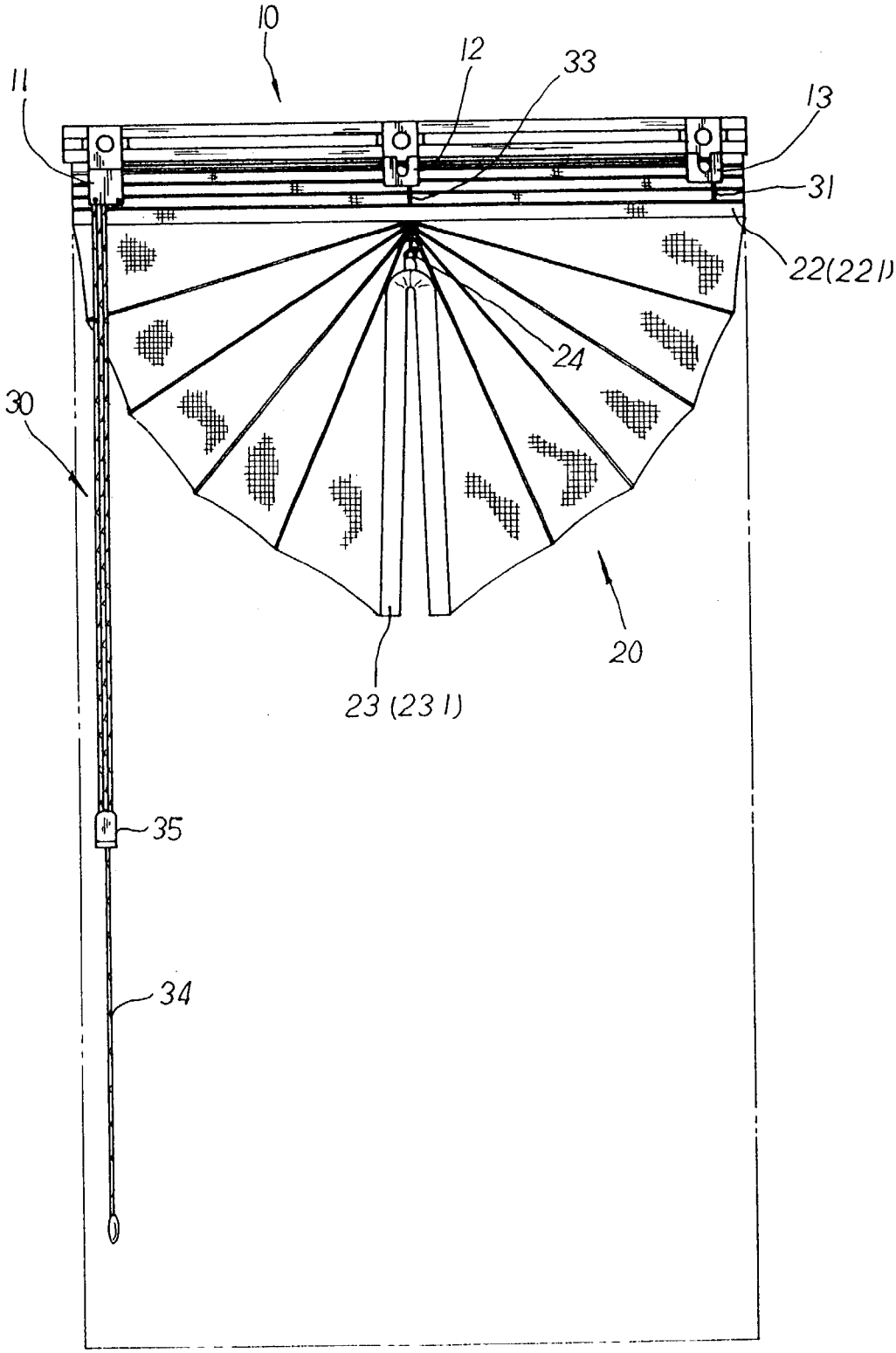
PRIOR ART FIG. 2
FIG. 2 is a diagram showing the conventional fabric drapery completely withdrawn.
Figure 3:
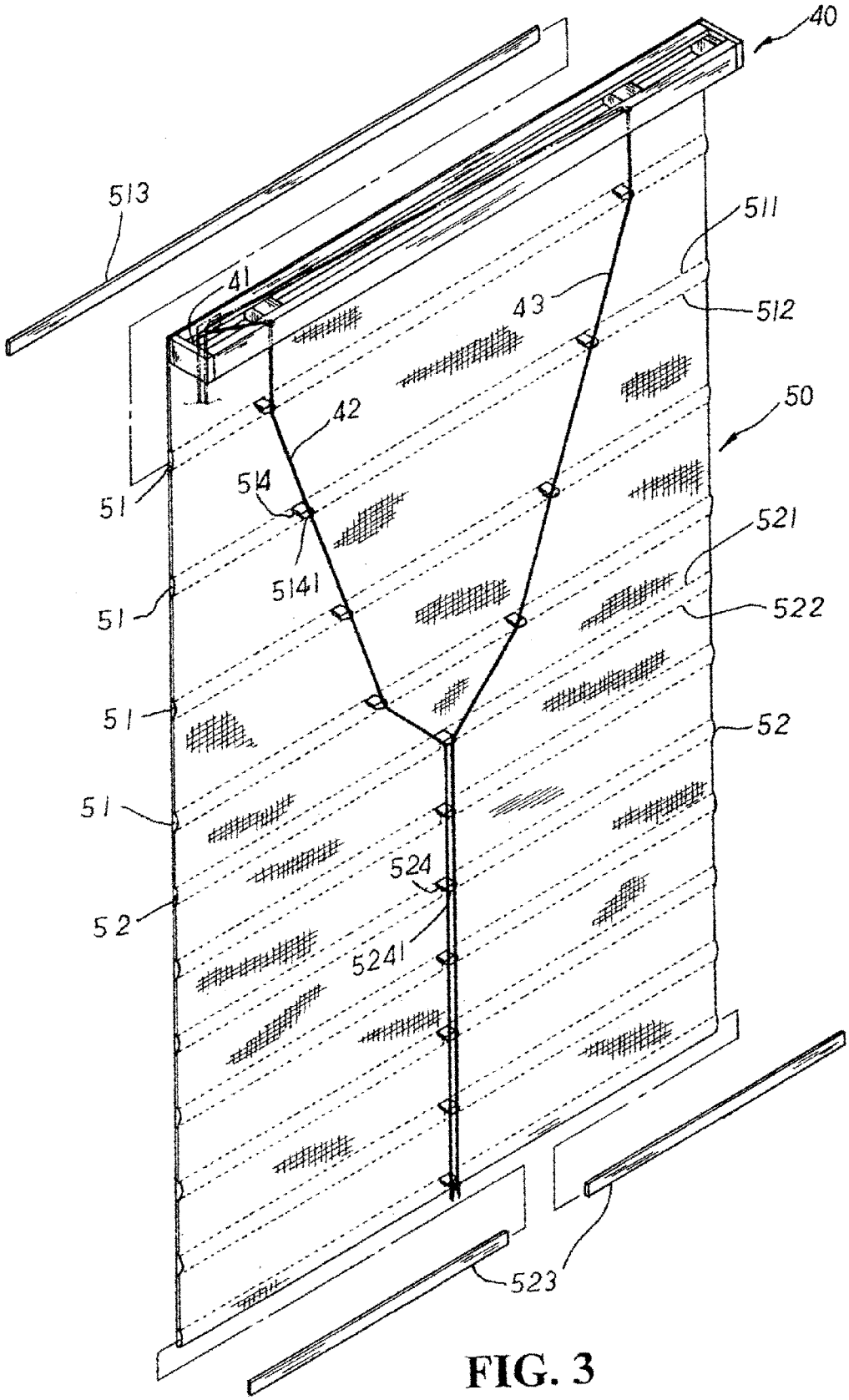
FIG. 3 is a perspective exploded view of the present invention.

Refer to FIG. 3. The present invention is related to a pattern variable fabric drapery, comprising an upper beam 40 with a double-layered fabric drapery 50 attached thereto. The upper section of the double-layered fabric drapery 50 is provided with a plurality of elongated tubular holes 51 equidistantly distributed thereon, each formed by an upper and a lower seaming lines 511, 512 for a long rod 513 to be adapted therein. The lower section of the double-layered fabric drapery 50 has a plurality of symmetrical left and right tubular holes 52 equidistantly arranged thereon, each pair thereof formed by an upper and a lower sewing lines 521, 522 and sealed up in the middle thereof for a pair of left and right elongated rods 523 to be adapted therein respectively. Both outer sides of the elongated tubular holes 51 and the left and right tubular holes 52 thereof are sealed up for location of the long rods 513 and the left and right elongated rods 523 thereof respectively. A plurality of left and right hanging pieces 514 each with a hanging ring 5141 attached thereto are symmetrically seamed into a V-shaped pattern at the upper seaming lines 511 of the elongated tubular holes 51 thereof, while a plurality of central hanging pieces 524 each with a cord-passage ring 5241 attached thereto are vertically disposed at the center of the upper sewing lines 521 of the left and right tubular holes 52, matching to the left and right hanging pieces 514 thereof to form a Y-shaped pattern at the fabric drapery 50 thereon.

A driving means 41 is disposed at one side of the upper beam 40 thereof for a left and a right pull cords 42, 43 to be adapted thereto. One end of the left and right pull cords 42, 43 are passed through the hanging rings 5141 of the left and right hanging pieces 514 respectively to come down together through the cord-passage rings 5241 of the central hanging pieces 524 and be tied up respectively to the last cord-passage ring 5241 disposed at the bottom of the fabric drapery 50 thereof. The other end of the left and right pull cords 42, 43, are led through the driving means 41 thereof to extend downwards thereof at one side of the fabric drapery 50 thereof.

Figure 4:
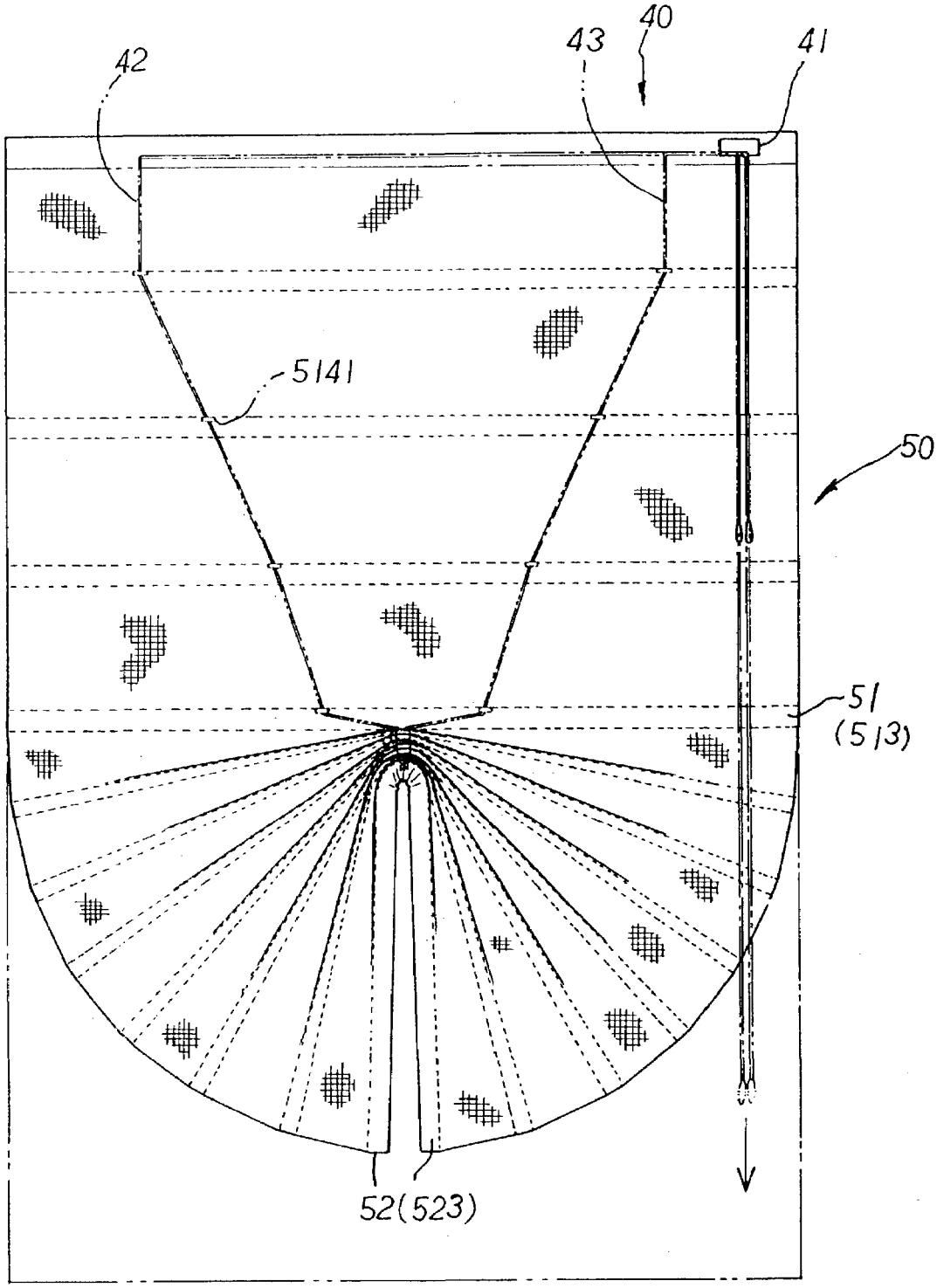
FIG. 4 is a diagram showing the present invention half gathered up.
Figure 5:
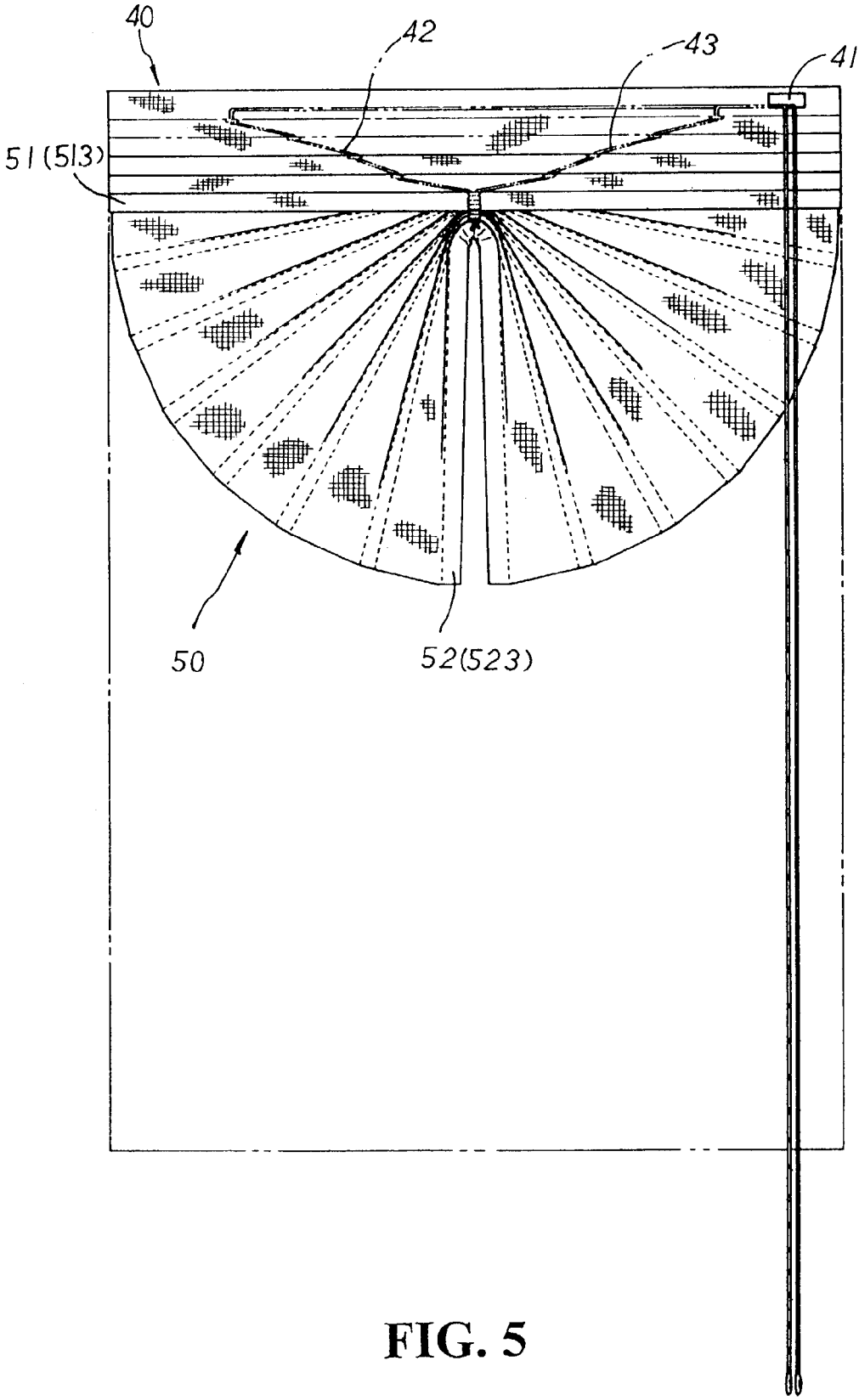
FIG. 5 is a diagram showing the present invention fully drawn up.

Refer to FIGS. 4, 5. To gather up the fabric drapery 50 thereof, the left and right pull cords 42, 43 suspending under the driving means 41 of the upper beam 40 thereof are pulled downwards to withdraw the left and right pull cords 42, 43, led through the left and right banging pieces 514 thereof and the central hanging pieces 524 thereof and fold up the fabric drapery 50 therewith. In a half-drawn stage of the fabric drapery 50, the left and right pull cords 42, 43 thereof are half drawn downwards to gather up the lower section of the fabric drapery 50 by the central hanging pieces 524 thereof with the left and the right elongated rods 523 suspending downwards at both sides thereof, variably figuring out a fan-like pattern at the bottom thereof as shown in FIG. 4. To fully gather up the fabric drapery 50, the left and right pull cords 42, 43 are fully drawn to the end to gather up the lower section of the fabric drapery 50 thereof in a fan-like shape, and then fold up the upper section of the fabric drapery 50 orderly via the long rods 513 raised levelly upwards by the withdrawn left and right pull cords 42, 43 thereof as shown in FIG. 5. Thus, via the left and right hanging pieces 514 and central hanging pieces 524 seamed into a Y-shaped pattern matching to the left and right pull cords 42, 43 without any preset extra length reserved, the fabric drapery 50 thereof is easily unfold or variably withdrawn, economically simplifying the process of assembly and reducing the costs of materials and production thereof.

Figure 6:
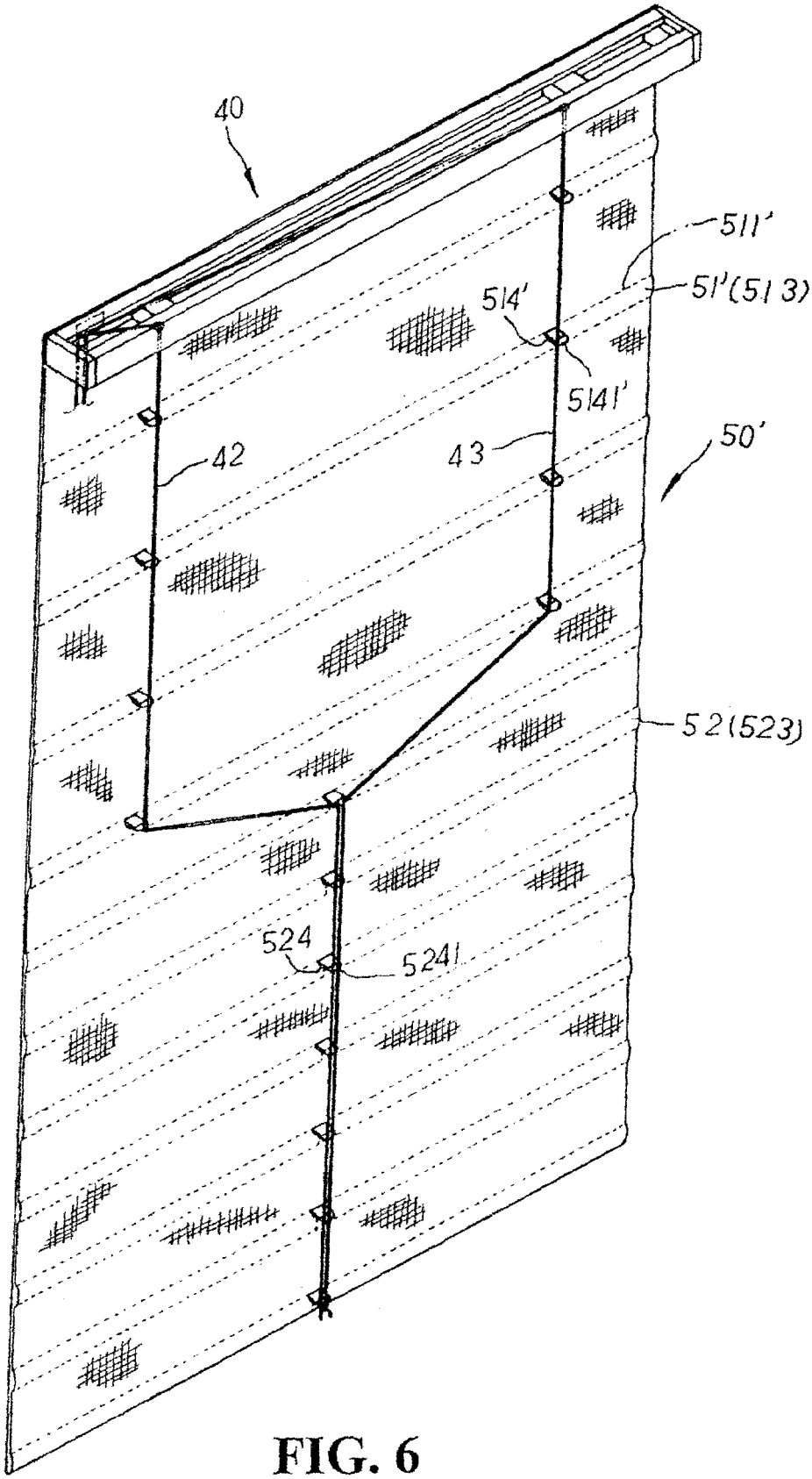
FIG. 6 is another embodiment of the present invention in assembly.

Refer to FIG. 6. A plurality of parallel left and right hanging pieces 514' with hanging rings 5141' attached thereto can also be disposed at the upper section of a fabric drapery 50' having a plurality of equidistant long rods 51' adapted at the upper section thereof. The left and right hanging pieces 514' are seamed in parallel to upper seaming lines 511' of the long rods 51' thereof for the left and right pull cords 42, 43 to be led there-through so as to gather up the upper section of the fabric drapery 50' orderly in folds via the long rods 51' when the left and right pull cords 42, 43 are fully withdrawn.

What is claimed is:

1. A variable pattern fabric drapery comprising:

a) an upper beam having a driving device;

b) a double-layered fabric drapery attached at a top thereof to the upper beam and having:

i) an upper section having a plurality of elongated tubular holes equally spaced thereon, each of the plurality of elongated tubular holes being formed by an upper seaming line and a lower seaming line;

ii) a plurality of long rods, one of the plurality of long rods is located in each of the plurality of elongated tubular holes;

iii) a lower section having a plurality of symmetrical left and right tubular holes equally spaced thereon, each pair of the plurality of symmetrical left and right tubular holes being formed by an upper sewing line and a lower sewing line and sealed there between;

iv) a plurality of pairs of left and right elongated rods, one rod of one of the plurality of pairs of left and right elongated rods is inserted in each hole of each pair of the plurality of symmetrical left and right tubular holes;

v) a plurality of left and right hanging pieces, each of the plurality of left and right hanging pieces having a hanging ring, one left hanging piece and one right hanging piece of the plurality of left and right hanging pieces are symmetrically spaced apart and connected to each upper seaming line; and vi) a plurality of central hanging pieces, each of the plurality of central hanging pieces having a cord passage ring, one of the plurality of central hanging pieces is connected to each upper sewing line; and c) a pair of pull cords including a left cord and a right cord, the left cord being inserted through the driving device, each hanging ring of the plurality of left hanging pieces, and each cord passage ring of the plurality of central hanging pieces, and tied at a first end to a lowest cord passage ring, and the right cord being inserted through the driving device, each hanging ring of the plurality of right hanging pieces, and each cord passage ring of the plurality of central hanging pieces, and tied at a first end to a lowest cord passage ring, wherein outermost ends of each of the plurality of elongated tubular holes and the plurality of symmetrical left and right tubular holes are sealed respectively securing the plurality of long rods and the plurality of pairs of left and right elongated rods therein, the upper section and the lower section of the double-layered fabric drapery are selectively movable between raised and lowered positions by selectively pulling and releasing the pair of pull cords, when the lower section is located in the raised position the plurality of pairs of left and right elongated rods are suspended downwardly forming a fan shape, when the upper section is located in the raised position the plurality of long rods are located in a horizontal position, and when the upper and lower sections are located in a lowered position the plurality of pairs of left and right elongated rods and the plurality of long rods are located in a horizontal position.

2. The variable pattern fabric drapery according to claim 1, wherein the plurality of left and right hanging pieces forming a V-shape pattern on the upper section.

3. The variable pattern fabric drapery according to claim 1, wherein the plurality of left and right hanging pieces forming two parallel vertical lines on the upper section.

* * * * *